US005628273A

United States Patent [19]

Crouse, II

[11] Patent Number: 5,628,273

[45] Date of Patent: May 13, 1997

[54] MISTING APPARATUS FOR A BOAT

[76] Inventor: Dale E. Crouse, II, 17030 N. 15 St. Apt. 1136, Phoenix, Ariz. 85022

[21] Appl. No.: 519,726

[22] Filed: Aug. 28, 1995

[51] Int. Cl.[6] ..... B63B 17/00

[52] U.S. Cl. ..... 114/343; 114/361; 114/270; 239/289

[58] Field of Search ..... 114/270, 187, 114/188, 361, 255, 343; 239/566, 289, 553; 440/38, 39, 113

[56] References Cited

U.S. PATENT DOCUMENTS

| | | | |
|---|---|---|---|
| 2,634,740 | 4/1953 | Duke | 114/361 |
| 3,233,573 | 2/1966 | Hamilton | 440/39 |
| 4,854,502 | 8/1989 | Cox | 239/289 |
| 5,000,384 | 3/1991 | Arnold | 239/289 |

*Primary Examiner*—Edwin L. Swinehart

[57] ABSTRACT

A misting apparatus for a boat comprised of a length of tubing secured to a frame supporting a canopy on a boat. A pick up tube is removably secured to a distal end of the length of tubing. A plurality of sprayers are secured to the length of tubing in a position beneath the canopy. A pump is adapted to receive the length of tubing therethrough. The pump will draw sea water through the pick up tube to be sprayed out of the plurality of sprayers.

3 Claims, 3 Drawing Sheets

MISTING APPARATUS FOR A BOAT

BACKGROUND OF THE INVENTION

1. Field of the Invention

The present invention relates to a misting apparatus for a boat and more particularly pertains to creating a fine mist to be sprayed into a boat with a misting apparatus for a boat.

2. Description of the Prior Art

The use of misting devices is known in the prior art. More specifically, misting devices heretofore devised and utilized for the purpose of delivering a water mist in numerous applications are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,340,345 to Brodbeck et al. discloses a water pickup cooling apparatus for boat drive systems.

U.S. Pat. No. 5,121,882 to Skidmore discloses a mist apparatus for sunbathing.

U.S. Pat. No. 4,765,542 to Carlson discloses a liquid misting attachment for sunbather's chair.

U.S. Pat. No. 3,759,449 to Ruthman et al. discloses a device for producing coolant mist.

While these devices fulfill their respective, particular objective and requirements, the aforementioned patents do not describe a misting apparatus for a boat for creating a fine mist to be sprayed into a boat.

In this respect, the misting apparatus for a boat according to the present invention substantially departs from the conventional concepts and designs of the prior art, and in doing so provides an apparatus primarily developed for the purpose of creating a fine mist to be sprayed into a boat.

Therefore, it can be appreciated that there exists a continuing need for new and improved misting apparatus for a boat which can be used for creating a fine mist to be sprayed into a boat. In this regard, the present invention substantially fulfills this need.

SUMMARY OF THE INVENTION

In the view of the foregoing disadvantages inherent in the known types of misting devices now present in the prior art, the present invention provides an improved misting apparatus for a boat. As such, the general purpose of the present invention, which will be described subsequently in greater detail, is to provide a new and improved misting apparatus for a boat and method which has all the advantages of the prior art and none of the disadvantages.

To attain this, the present invention essentially comprises a length of tubing secured to a frame supporting a canopy on a boat. The length of tubing is secured to the frame by a plurality of hose ties spaced equally therealong. The length of tubing is secured to the canopy by a plurality of clips spaced equally therealong. The device includes a pick up tube comprised of an elbow shaped tube having an open first end and an open second end. The open first end has a screened pick up mechanism secured thereto. The open second end has a rigid threaded tube secured thereto. The rigid threaded tube extends inwardly of a hull portion of a boat. An opposing end of the threaded tube has a hose nipple secured thereto. The hose nipple is removably secured to a distal end of the length of tubing. A plurality of sprayers are secured to the length of tubing in a position beneath the canopy. A filter is adapted to receive the length of tubing therethrough. A pump is adapted to receive the length of tubing therethrough. The pump is positioned between the filter and the plurality of sprayers whereby the pump will draw sea water through the pick up tube and through the filter to be sprayed out of the plurality of sprayers. An activation switch is secured within the boat positioned accessibly for a user whereby the activation switch activates or deactivates the pump.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved misting apparatus for a boat which has all the advantages of the prior art misting devices and none of the disadvantages.

It is another object of the present invention to provide a new and improved misting apparatus for a boat which may be easily and efficiently manufactured and marketed.

It is a further object of the present invention to provide a new and improved misting apparatus for a boat which is of durable and reliable construction.

An even further object of the present invention is to provide a new and improved misting apparatus for a boat which is susceptible of a low cost of manufacture with regard to both materials and labor, and which accordingly is then susceptible of low prices of sale to the consuming public, thereby making such a misting apparatus for a boat economically available to the buying public.

Still yet another object of the present invention is to provide a new and improved misting apparatus for a boat which provides in the apparatuses and methods of the prior art some of the advantages thereof, while simultaneously overcoming some of the disadvantages normally associated therewith.

Even still another object of the present invention is to provide a new and improved misting apparatus for a boat for creating a fine mist to be sprayed into a boat.

Lastly, it is an object of the present invention to provide a new and improved misting apparatus for a boat comprised of a length of tubing secured to a frame supporting a canopy on a boat. A pick up tube is removably secured to a distal end of the length of tubing. A plurality of sprayers are secured to the length of tubing in a position beneath the canopy. A pump is adapted to receive the length of tubing therethrough. The pump will draw sea water through the pick up tube to be sprayed out of the plurality of sprayers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
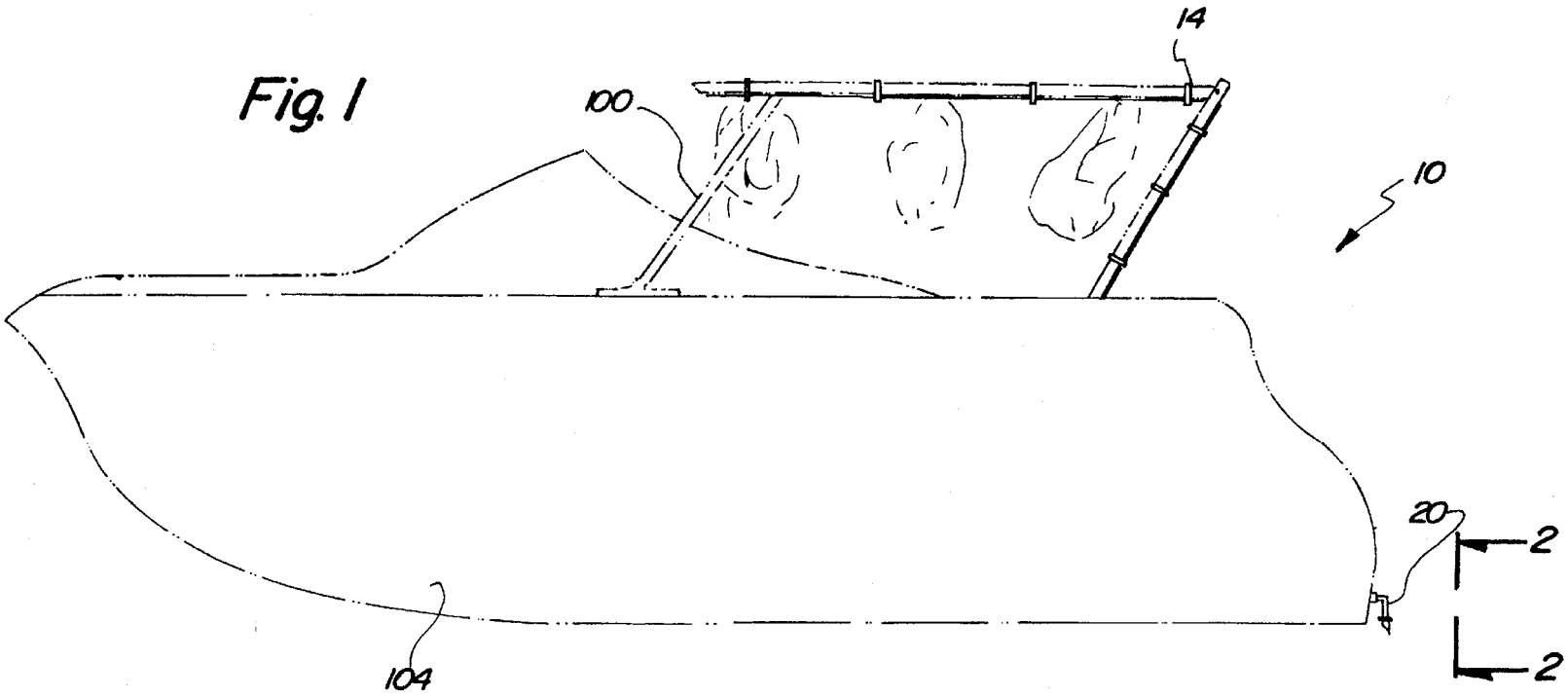
FIG. 1 is a side view of the preferred embodiment of the misting apparatus for a boat constructed in accordance with the principles of the present invention.
Figure 2:
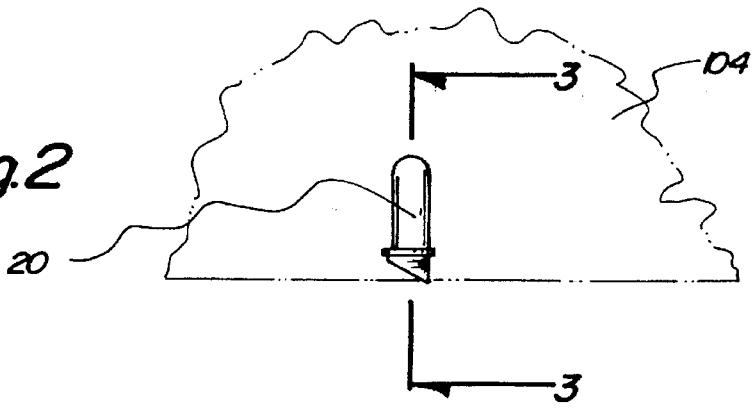
FIG. 2 is a cross-sectional view as taken along line 2—2 of FIG. 1.

With reference now to the drawings, and in particular, to FIGS. 1–6 thereof, the preferred embodiment of the new and improved misting apparatus for a boat embodying the principles and concepts of the present invention and generally designated by the reference number 10 will be described.

Specifically, it will be noted in the various Figures that the device relates to a new and improved misting apparatus for a boat for creating a fine mist to be sprayed into a boat. In its broadest context, the device consists of a length of tubing, a pick up tube, a plurality of sprayers, a filter, a pump, and an activation switch. Such components are individually configured and correlated with respect to each other so as to attain the desired objective.

The device 10 includes a length of tubing 12 secured to a frame 100 supporting a canopy 102 on a boat 104. The length of tubing 12 is secured to the frame 100 by a plurality of hose ties 14 spaced equally therealong. The plurality of hose ties 14 are each wrapped around the frame 100 and is equipped with hook and loop fasteners or some other securement means to removably fasten the length of tubing 12 to the frame 100. The length of tubing 12 is secured to the canopy 102 by a plurality of clips 16 spaced equally therealong. The plurality of clips 16 resemble those used to clip identification badges to shirts thus allowing for the easy removal from the canopy 102. The length of tubing 12 is constructed of a flexible rubber or plastic to allow it to be easily secured in place. This would allow for the length of tubing 12 to be stretched into a variety of shapes to accommodate various geometric patterns of canopy configurations of different sized boats. See FIG. 1.

Figure 3:
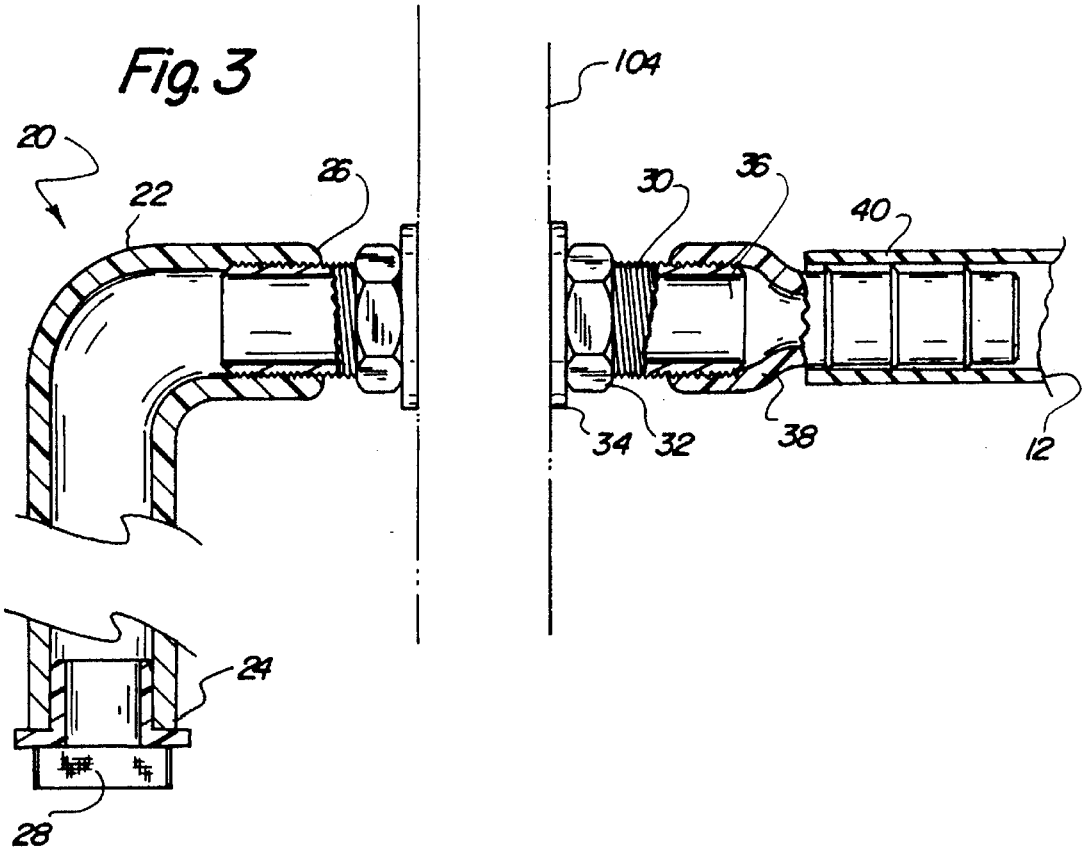
FIG. 3 is a cross-sectional view as taken along line 3—3 of FIG. 2.

FIG. 3 illustrates a pick up tube 20 comprised of an elbow shaped tube 22 having an open first end 24 and an open second end 26. The open first end 24 has a screened pick up mechanism 28 secured thereto. The open second end 26 has a rigid threaded tube 30 secured thereto. The rigid threaded tube 30 extends inwardly of a hull portion of the boat 104. The threaded tube 30 is secured in place by a nut 32 and washer 34 arrangement inside and outside of the hull portion of the boat. An opposing end 36 of the threaded tube 30 has a hose nipple 38 secured thereto. The hose nipple 38 is removably secured to a distal end 40 of the length of tubing 12. The open first end 24 extends into the water and serves to receive water therein to be transported into the length of tubing 12. The screened pick up mechanism 28 obstructs and any objects from entering into the open first end 24.

Figure 4:
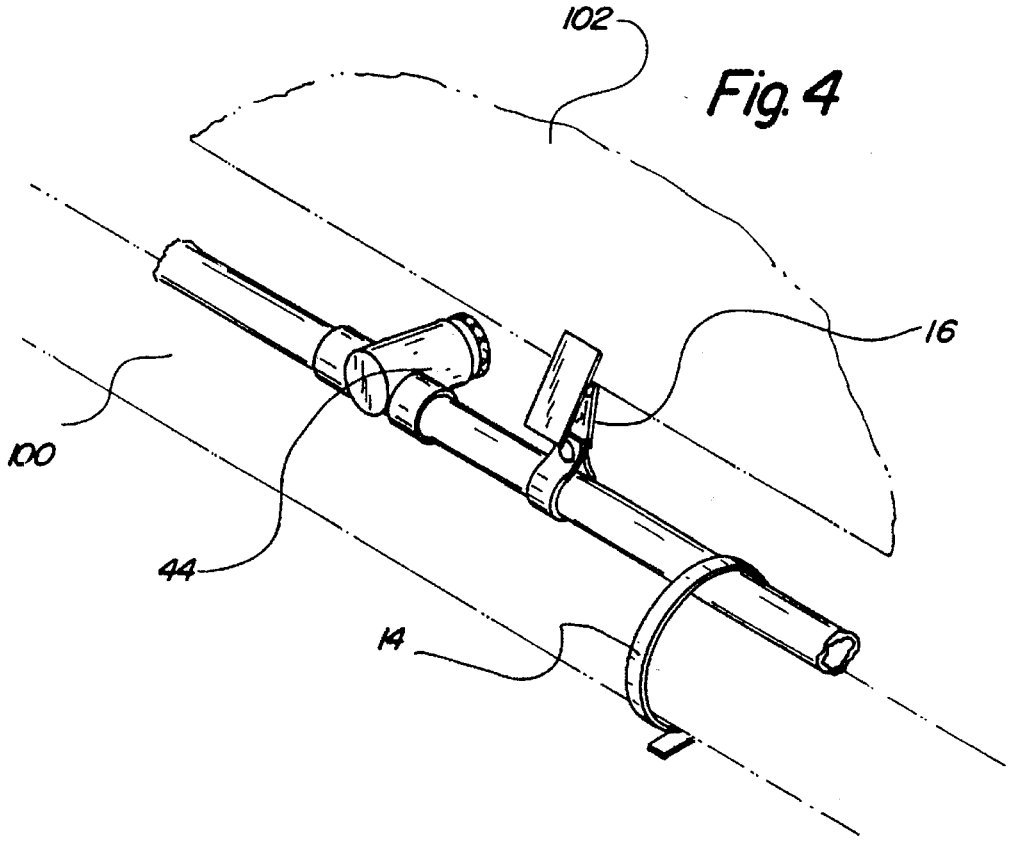
FIG. 4 is a perspective view of the sprinkler and canopy clip of the present invention.
Figure 5:
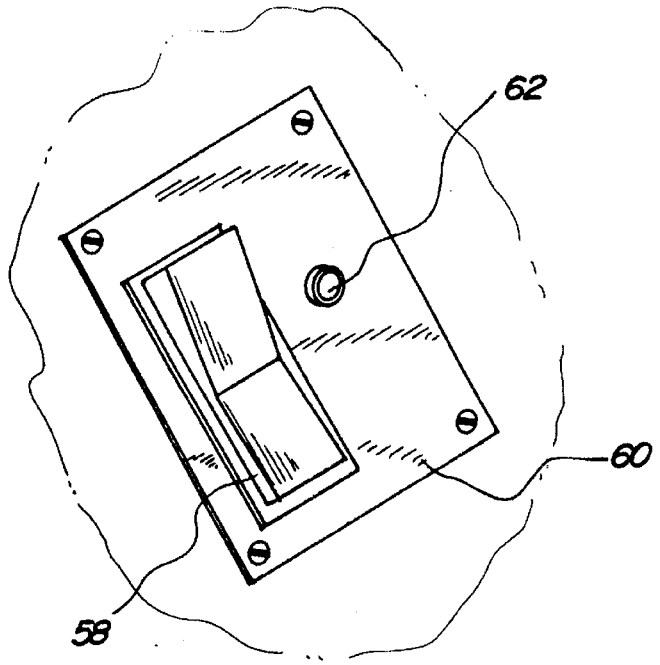
FIG. 5 is a perspective view of the activation switch of the present invention.

FIG. 4 illustrates one of a plurality of sprayers 44 secured to the length of tubing 12 in a position beneath the canopy 102. The sprayers 44 serve to spray water received from the length of tubing 12 onto the passengers on the boat 104 to cool them down during a hot day.

A filter 48 is adapted to receive the length of tubing 12 therethrough. The filter 48, illustrated in FIG. 6, serves to clean the sea water that is transported through the length of tubing 12 to the plurality of sprayers 44. The length of tubing 12 enters one side of the filter 48 carrying unfiltered water and exits on an opposing side of the filter 48 with filtered water to be sprayed out of the plurality of sprayers 44.

Figure 6:
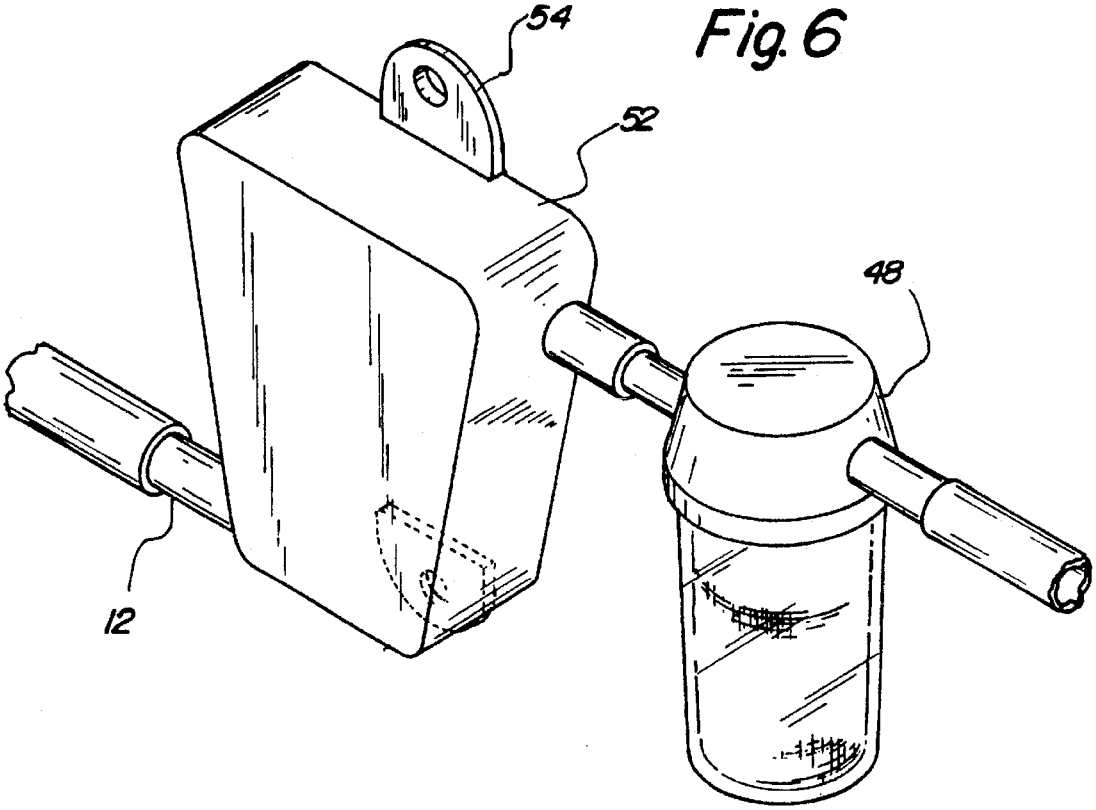
FIG. 6 is a perspective view of the pump and the filter of the present invention.

A pump 52 is adapted to receive the length of tubing 12 therethrough. The pump 52 is positioned between the filter 48 and the plurality of sprayers 44 whereby the pump 52 will draw sea water through the pick up tube 20 and through the filter 48 to be sprayed out of the plurality of sprayers 52. The pump is equipped with a pair of securement brackets 54 that allow for the pump 52 to be secured within the boat preferably in a position not visible to passengers on the boat 104. The pump 52 is best illustrated in FIG. 6.

An activation switch 58 is secured within the boat 104 positioned accessibly for a user whereby the activation switch 58 activates or deactivates the pump 52. The activation switch 58 is positioned on a panel 60 secured to the boat 104. The panel 60 is equipped with an indicator light 62 which alerts the user as to the status of the device 10, whether activated or deactivated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A misting apparatus for an attachment to a boat for creating a fine mist to be sprayed into a boat comprising, in combination:

a length of tubing secured to a frame supporting a canopy on a boat, the length of tubing being secured to the frame by a plurality of hose ties spaced equally therealong, the length of tubing being secured to the canopy by a plurality of clips spaced equally therealong;

a pick up tube comprising an elbow shaped tube having an open first end and an open second end, the open first end having a screened pick up mechanism secured thereto, the open second end having a rigid threaded tube secured thereto, the rigid threaded tube extending inwardly of a hull portion of a boat, an opposing end of the threaded tube having a hose nipple secured thereto, the hose nipple being removably secured to a distal end of the length of tubing;

a plurality of sprayers secured to the length of tubing in a position beneath the canopy;

a pump adapted to receive the length of tubing therethrough, the pump being positioned whereby the pump will draw sea water through the pick up tube to be sprayed out of the plurality of sprayers;

an activation switch secured within the boat positioned accessibly for a user whereby the activation switch activates or deactivates the pump.

2. A misting apparatus for an attachment to a boat for creating a fine mist to be sprayed into a boat comprising, in combination:

a length of tubing secured to a frame supporting a canopy on a boat;

a pick up tube removably secured to a distal end of the length of tubing;

a plurality of sprayers secured to the length of tubing in a position beneath the canopy;

a pump adapted to receive the length of tubing therethrough, the pump will draw sea water through the pick up tube to be sprayed out of the plurality of sprayers; and the length of tubing being secured to the frame by a plurality of hose ties spaced equally therealong, the length of tubing being secured to the canopy by a plurality of clips spaced equally therealong.

3. A misting apparatus for an attachment to a boat for creating a fine mist to be sprayed into a boat comprising, in combination:

a length of tubing secured to a frame supporting a canopy on a boat;

a pick up tube removably secured to a distal end of the length of tubing;

a plurality of sprayers secured to the length of tubing in a position beneath the canopy;

a pump adapted to receive the length of tubing therethrough, the pump will draw sea water through the pick up tube to be sprayed out of the plurality of sprayers; and the pick up tube comprising an elbow shaped tube having an open first end and an open first end and an open second end, the open first end having a screened pick up mechanism secured thereto, the open second end having a rigid threaded tube secured thereto, the rigid threaded tube extending inwardly of a hull portion of a boat, an opposing end of the threaded tube having a hose nipple secured thereto, the hose nipple being removably secured to a distal end of the length of tubing.

* * * * *